US010195515B2

(12) United States Patent
Mayer

(10) Patent No.: US 10,195,515 B2
(45) Date of Patent: Feb. 5, 2019

(54) ICE SKATE ATTACHMENT

(71) Applicant: Rollergard, LLC, St. Charles, MI (US)

(72) Inventor: David J. Mayer, St. Charles, MI (US)

(73) Assignee: Rollergard LLC, St. Charles, MI (US)

( * ) Notice: Subject to any disclaimer, the term of this patent is extended or adjusted under 35 U.S.C. 154(b) by 371 days.

(21) Appl. No.: 14/262,265

(22) Filed: Apr. 25, 2014

(65) Prior Publication Data

US 2014/0319790 A1 Oct. 30, 2014

Related U.S. Application Data

(60) Provisional application No. 61/816,000, filed on Apr. 25, 2013.

(51) Int. Cl.

| | |
|---|---|
| ***A63C 1/36*** | (2006.01) |
| ***A63C 3/12*** | (2006.01) |
| ***A63C 1/30*** | (2006.01) |

(52) U.S. Cl.

CPC ..... *A63C 3/12* (2013.01); *A63C 1/303* (2013.01); *A63C 1/36* (2013.01); *A63C 2203/06* (2013.01); *Y10T 29/49895* (2015.01)

(58) Field of Classification Search

CPC ..... A63C 3/08; A63C 3/12; A63C 2203/06; A63C 2203/065; A63C 1/30; A63C 1/303; A63C 1/32; A63C 1/34; A63C 1/35

See application file for complete search history.

(56) References Cited

U.S. PATENT DOCUMENTS

| | | | | |
|---|---|---|---|---|
| 226,835 | A | 4/1880 | Chesterman | |
| 250,319 | A | 11/1881 | Yates | |
| 310,923 | A | 1/1885 | Wardell | |
| 339,318 | A | 4/1886 | Peer | |
| 475,926 | A * | 5/1892 | Bryant | A63C 1/30 280/11.12 |
| 544,490 | A * | 8/1895 | Bryant | A63C 1/30 280/11.12 |
| 1,174,601 | A | 3/1916 | Nathan | |
| 1,341,853 | A | 6/1920 | Johnson | |
| 1,346,568 | A | 7/1920 | Swift | |
| 1,447,431 | A | 3/1923 | Ritter | |
| 1,544,770 | A | 7/1925 | Swift | |
| 1,554,434 | A | 9/1925 | Johnson | |
| 1,557,415 | A | 10/1925 | Carey | |
| 1,658,093 | A | 2/1928 | Nygaard | |
| 1,788,433 | A | 1/1931 | Johnson | |
| 1,925,697 | A | 9/1933 | Johnson | |

(Continued)

FOREIGN PATENT DOCUMENTS

CH 604785 9/1978

*Primary Examiner* — Frank B Vanaman

(74) *Attorney, Agent, or Firm* — Robert L. Stearns; Dickinson Wright, PLLC

(57) ABSTRACT

An ice skate attachment assembly for converting a single runner blade ice skate into as multiple runner blade ice skate is provided. The assembly includes a skate guard having a bottom surface and including a channel for receiving and supporting the single runner blade of the ice skate. The assembly further includes at least two multi-runner blades secured with the skate guard and being laterally spaced from one another on either lateral side of the skate guard with each of the multi-runner blades extending below the bottom surface of the skate guard to an ice-engaging edge.

3 Claims, 5 Drawing Sheets

(56) References Cited

U.S. PATENT DOCUMENTS

| | | | | | |
|---|---|---|---|---|---|
| 1,982,524 | A | | 11/1934 | Kutchera | |
| 2,181,834 | A | | 11/1939 | Pierce | |
| 2,213,966 | A | | 9/1940 | Oscar | |
| 2,216,438 | A | * | 10/1940 | Hamilton | A63C 1/36 280/11.12 |
| 2,395,394 | A | | 2/1946 | Carlson | |
| 2,642,291 | A | | 6/1953 | Condon | |
| 2,764,417 | A | * | 9/1956 | Sweet | A63C 1/36 280/11.12 |
| D189,923 | S | | 3/1961 | Swatt | |
| 3,015,492 | A | | 1/1962 | Kesner | |
| 3,120,397 | A | * | 2/1964 | Zwahlen | A63C 3/04 280/11.12 |
| 3,135,526 | A | | 6/1964 | Johns | |
| 3,281,971 | A | | 11/1966 | Weitzner | |
| 3,292,940 | A | | 12/1966 | Weitzner | |
| 3,338,588 | A | * | 8/1967 | Couture | A63C 3/12 280/825 |
| 3,583,720 | A | | 6/1971 | Fowlkes | |
| 3,954,278 | A | | 5/1976 | McLeod | |
| 4,252,345 | A | | 2/1981 | Cabral | |
| 4,264,090 | A | | 4/1981 | Davies | |
| 4,324,408 | A | | 4/1982 | Bensette et al. | |
| 4,382,616 | A | | 5/1983 | Olivieri | |
| 4,392,674 | A | | 7/1983 | Evon | |
| D271,410 | S | | 11/1983 | Olivieri | |
| 4,492,385 | A | | 1/1985 | Olson | |
| 4,546,999 | A | | 10/1985 | Lehr | |
| 4,603,868 | A | | 8/1986 | Schutz | |
| 4,673,196 | A | | 6/1987 | Hall | |
| 5,183,292 | A | | 2/1993 | Ragin | |
| 5,290,065 | A | | 3/1994 | Kassal | |
| 5,303,955 | A | | 4/1994 | Zurnamer | |
| 5,513,881 | A | | 5/1996 | DiMeglio et al. | |
| 5,573,275 | A | | 11/1996 | Smith et al. | |
| 5,580,094 | A | | 12/1996 | Ruehlman et al. | |
| 5,697,643 | A | | 12/1997 | Marasco et al. | |
| 5,765,870 | A | | 6/1998 | Riley | |
| 5,848,808 | A | | 12/1998 | Fenton | |
| 5,941,568 | A | | 8/1999 | White | |
| 5,988,682 | A | | 11/1999 | Allera | |
| 6,032,962 | A | | 3/2000 | DiGregorio | |
| 6,142,528 | A | | 11/2000 | Riley | |
| 6,193,277 | B1 | | 2/2001 | Marasco et al. | |
| D453,204 | S | | 1/2002 | Haldenby | |
| 6,446,982 | B1 | | 9/2002 | Gaster et al. | |
| 6,467,198 | B1 | | 10/2002 | James | |
| 6,666,479 | B1 | | 12/2003 | Maddaleni | |
| 6,916,046 | B2 | | 7/2005 | Riley et al. | |
| 7,192,059 | B2 | | 3/2007 | Guyon et al. | |
| D566,216 | S | | 4/2008 | Mayer et al. | |
| D574,458 | S | | 8/2008 | Mayer et al. | |
| 7,866,705 | B2 | | 1/2011 | Mayer et al. | |
| 8,382,161 | B2 | | 2/2013 | Mayer et al. | |
| 9,039,043 | B2 | * | 5/2015 | Schoenike | A63C 3/12 280/825 |
| 2002/0105153 | A1 | | 8/2002 | Miller et al. | |
| 2002/0175481 | A1 | | 11/2002 | Steinhauser | |
| 2003/0011149 | A1 | | 1/2003 | Gaster et al. | |
| 2004/0032098 | A1 | | 2/2004 | Gaster et al. | |
| 2004/0140661 | A1 | | 7/2004 | Guyon et al. | |
| 2005/0067800 | A1 | | 3/2005 | Alglave | |
| 2005/0127661 | A1 | | 6/2005 | Cuerrier | |
| 2007/0075540 | A1 | | 4/2007 | Steinhauser | |

* cited by examiner

ICE SKATE ATTACHMENT

CROSS-REFERENCE TO RELATED APPLICATION

This application claims the benefit of application Ser. No. 61/816,000, filed Apr. 25, 2013, the disclosure of which is incorporated herein by reference.

BACKGROUND OF THE INVENTION

1. Field of the Invention

The present invention relates generally to attachments for ice skates and to ice skating training devices.

2. Related Art

Traditional hockey and figure ice skates include a boot and a single runner blade runner which is affixed to a bottom surface of the boot via a support frame. People who are just learning to ice skate often have difficulty using such traditional ice skates because they have difficulty stabilizing themselves on an ice surface. Accordingly, some ice skating manufacturers produce and sell beginner ice skates which have a pair of laterally spaced apart runner blades for improving the stabilization of the novice ice skater. However, such beginner ice skates are undesirable since they are an added expense and are soon outgrown as the person learning to skate reaches a stage of proficiency where the double runner blades are no longer needed. Once this occurs, the person or his or her parents, is faced with having to purchase a traditional, single-runner blade set of skates at an added cost.

It is also common for skaters to utilize some type of skate guard to cover and protect their runner blades when not in use or when wearing the skates on any surface other than ice. Such skate guards are typically made of rubber or plastic materials and have a general elongate channel shape which enables the user to slip the guards over the runner blades such that a lower edge of each runner blade is captured in the channel of the guard. A strap of some sort is typically wrapped about the support frame of the skate to secure the blade guard on the skate.

SUMMARY OF THE INVENTION AND ADVANTAGES

An aspect of the present invention provides for an ice skate attachment assembly or converting a single runner blade ice skate into a multiple runner blade ice skate. The assembly includes a skate guard having a bottom surface and including a channel for receiving and supporting the single runner blade of the ice skate. The assembly further includes at least two multi-runner blades which are secured with the skate guard and are spaced laterally from one another on either lateral side of the skate guard with each multi-runner blade extending below the bottom surface of the skate guard to an ice engaging edge.

The ice skate attachment assembly is advantageous because it allows a novice ice skater to learn to skate on ice skates with multiple runner blades, which may be more stable than single runner blade ice skates, at a minimum cost. As such, the benefit of multiple runner blades is provided to the user with less waste and cost than purchasing a pair of multi-runner ice skates at full cost and then discarding them soon after he or she has reached a level of proficiency where he or she is able to skate effectively on single runner blade ice skates.

According to a further aspect of the present invention, the multi-runner blades are detachably joined with the skate guard. This feature is further advantageous because once the user reaches a level of proficiency where he or she is able to skate on the single runner blades of his or her ice skates, he or she may detach the multi-runner blades from the skate guard and use the skate guard in the manner of a traditional skate guard.

Another aspect of the present invention provides for an ice skate attachment kit for converting a single runner ice skate into a multiple runner blade ice skate. The kit includes at least two multi-runner blades, each of which has an ice-engaging edge and mounting hardware for detachably connecting the multi-runner blades with a skate guard on opposite lateral sides of the skate guard. The kit may include the skate guard for convenience, or the skate guard may be excluded to allow a user to use convert his or her own skate guard.

Yet another aspect of the present invention provides for a method of converting a single runner blade ice skate into a multiple runner blade ice skate. The method includes the step of preparing an ice skate having a boot and a single runner blade joined with the boot via a support frame. The method continues with the step of preparing an ice skate assembly including a skate guard with a longitudinally extending channel and at least two multi-runner blades secured on opposite lateral sides of the skate guard. The method proceeds with the step of guiding the single runner blade of the ice skate into the channel of the skate guard. This process is quick and can be accomplished with little effort and without any special tools.

Still another aspect of the present invention is a method of detachably mounting a pair of multi-runner blades onto a skate guard for a single runner blade ice skate. The method includes the step of preparing a skate guard having a bottom surface, a top surface with a longitudinally extending channel and at least two openings spaced longitudinally from one another. The method proceeds with the step of positioning at least two multi-runner blades on opposite lateral sides of the skate guard so that at least two longitudinally spaced apertures on each of the multi-runner blades align with the openings in the skate guard and so that a bottom ice-engaging edge of each multi-runner blade is spaced vertically below the bottom surface of the skate guard. The method proceeds with the step of inserting fasteners through the aligned ones of the apertures in the multi-runner blades and openings in the skate guard to detachably secure the multi-runner blades with the skate guard on either lateral side of the skate guard.

BRIEF DESCRIPTION OF THE DRAWINGS

These and other features and advantages of the present invention will be readily appreciated, as the same becomes better understood by reference to the following detailed description when considered in connection with the accompanying drawings wherein.

DESCRIPTION OF THE ENABLING EMBODIMENT

Figure 1:
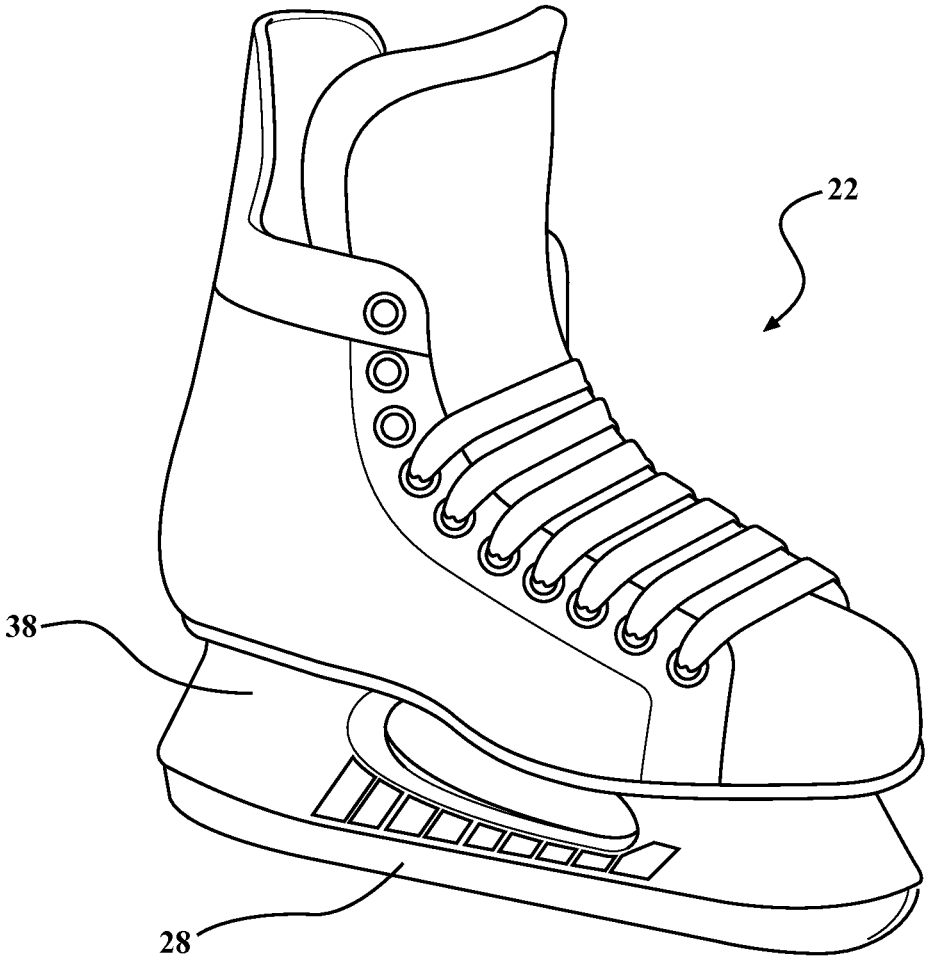
FIG. 1 is a perspective view of a single runner blade ice skate.

Referring to the drawings, wherein like numerals indicate corresponding parts throughout the several views, an ice skate attachment assembly 20 constructed according to an exemplary embodiment is shown in FIGS. 3-6. The ice skate attachment assembly 20 is configured to be quickly and releasably engaged with traditional, single runner blade ice skate 22 (either a figure skate or an ice skate 22) in the usual manner of a skate guard 24 but further includes a pair of multi-runner blades 26 which serve to convert the traditional ice skate 22 into a multi-runner ice skate. Once a user has advanced to the point where he or she is proficient enough to skate on a single runner blade 28, he or she may simply remove the ice skate attachment assembly 20 to utilize the now-exposed single runner blade 28 of the ice skate 22. As such, a person who is just learning to skate can purchase a standard pair of traditional ice skates 22 and easily, and temporarily, convert those traditional ice skates 22 into a set of multi-runner blade ice skates. The ice skate attachment assembly 20 is further adaptable so that the multi-runner blades 26 can be selectively removed so that the user may utilize the skate guard 24 in the manner of a traditional skate guard 24 to protect the single runner blade 28 from damage while walking on a non-ice surface. The ice skate attachment assembly 20 may be configured for use with both hockey skates, such as the ice skate 22 shown in FIG. 1, or with figure skates (not shown).

Figure 3:
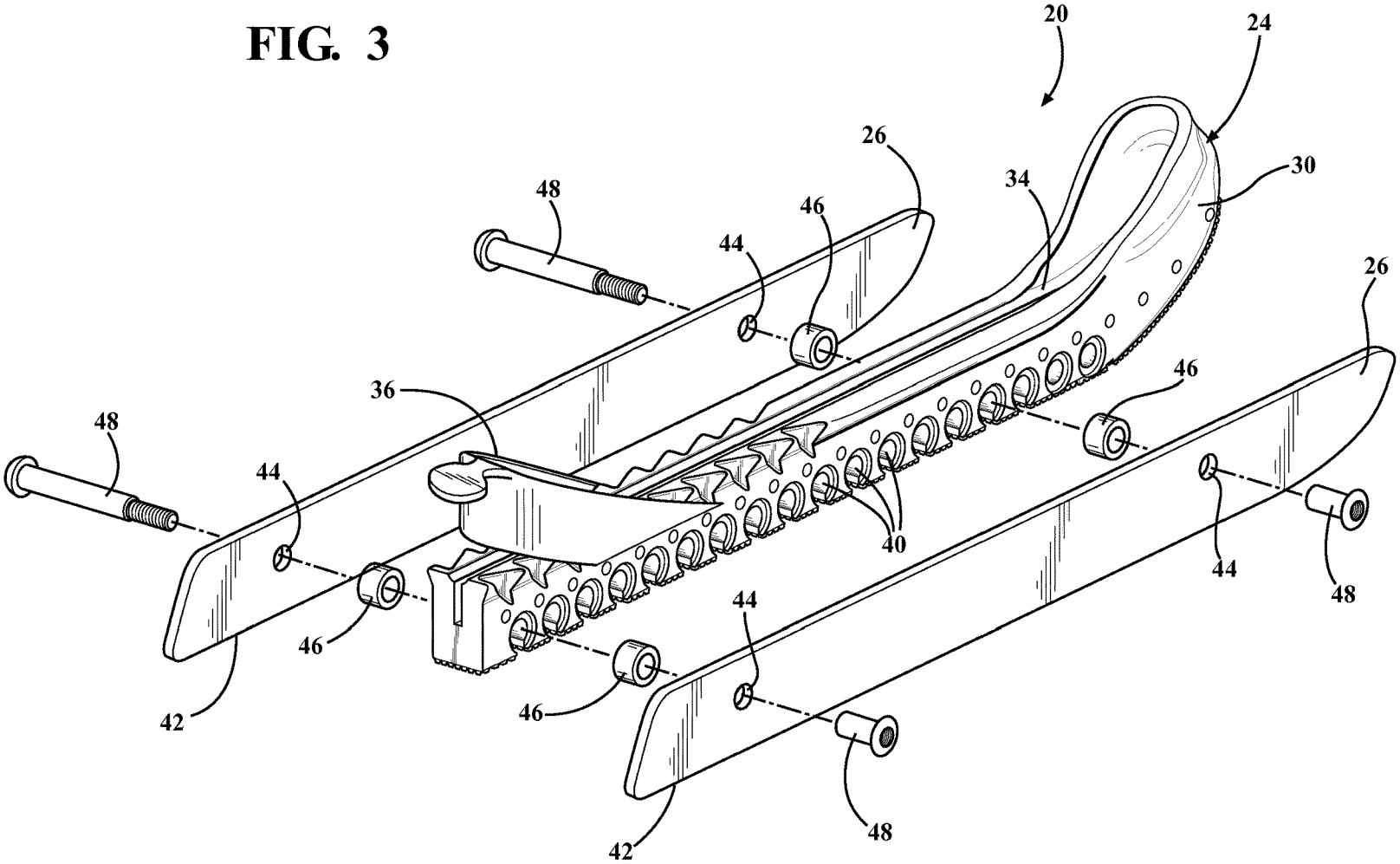
FIG. 3 is an exploded view of an exemplary embodiment of an ice skate attachment assembly.
Figure 4:
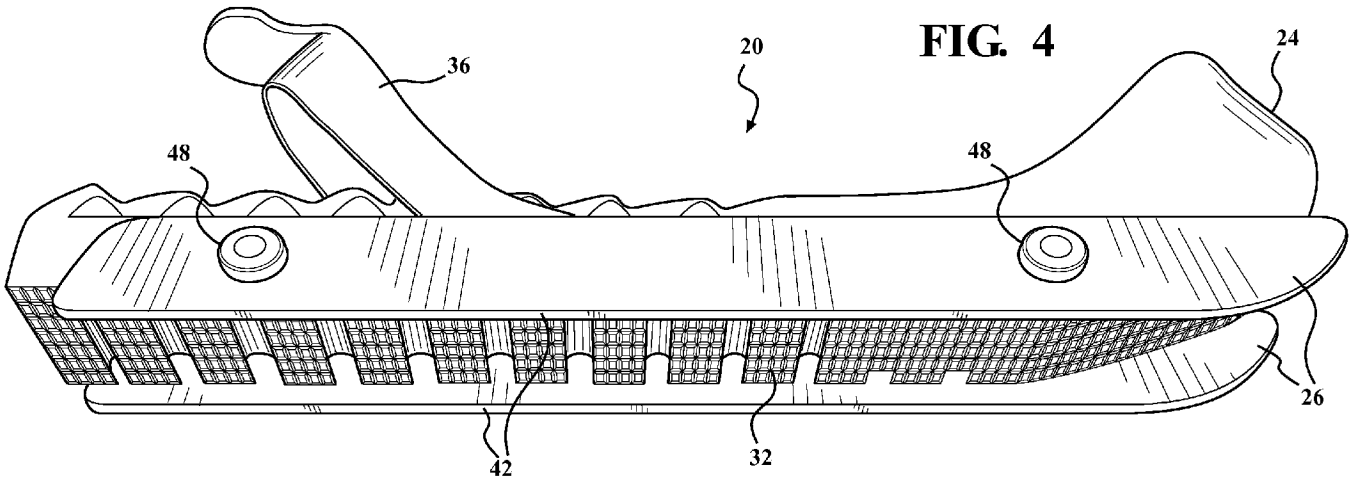
FIG. 4 is a perspective view of the ice skate attachment assembly of FIG. 3 in an assembled state.
Figure 5:
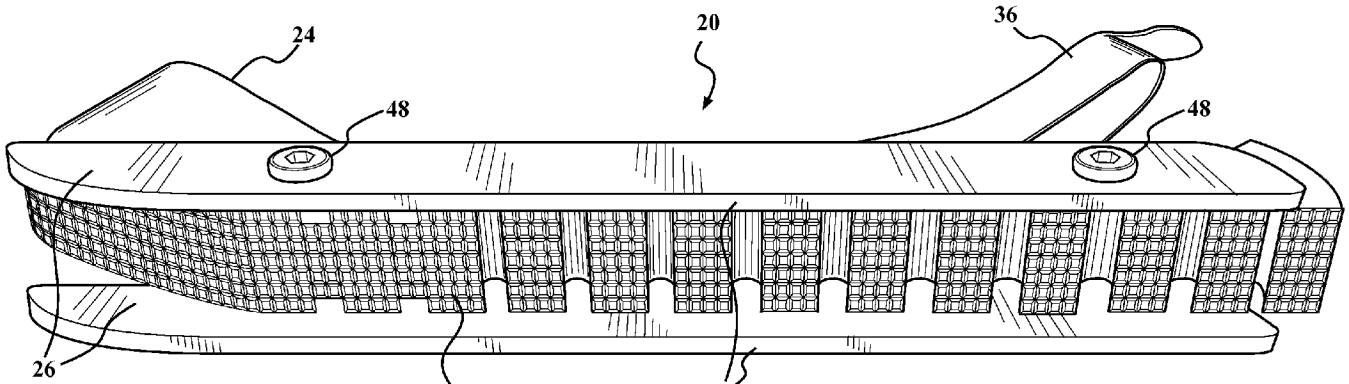
FIG. 5 is another perspective view of the ice skate attachment assembly of FIG. 3 in an assembled state and taken from a different viewpoint from FIG. 4.

Referring now to FIG. 3, the ice skate attachment assembly 20 may be packaged in a kit including a skate guard 24, at least two multi-runner blades 26 and mounting hardware for joining the multi-runner blades 26 with the skate guard 24. Alternately, the kit could only include the multi-runner blades 26 and the mounting hardware, thereby allowing a user to choose his or her own skate guard.

Figure 2:
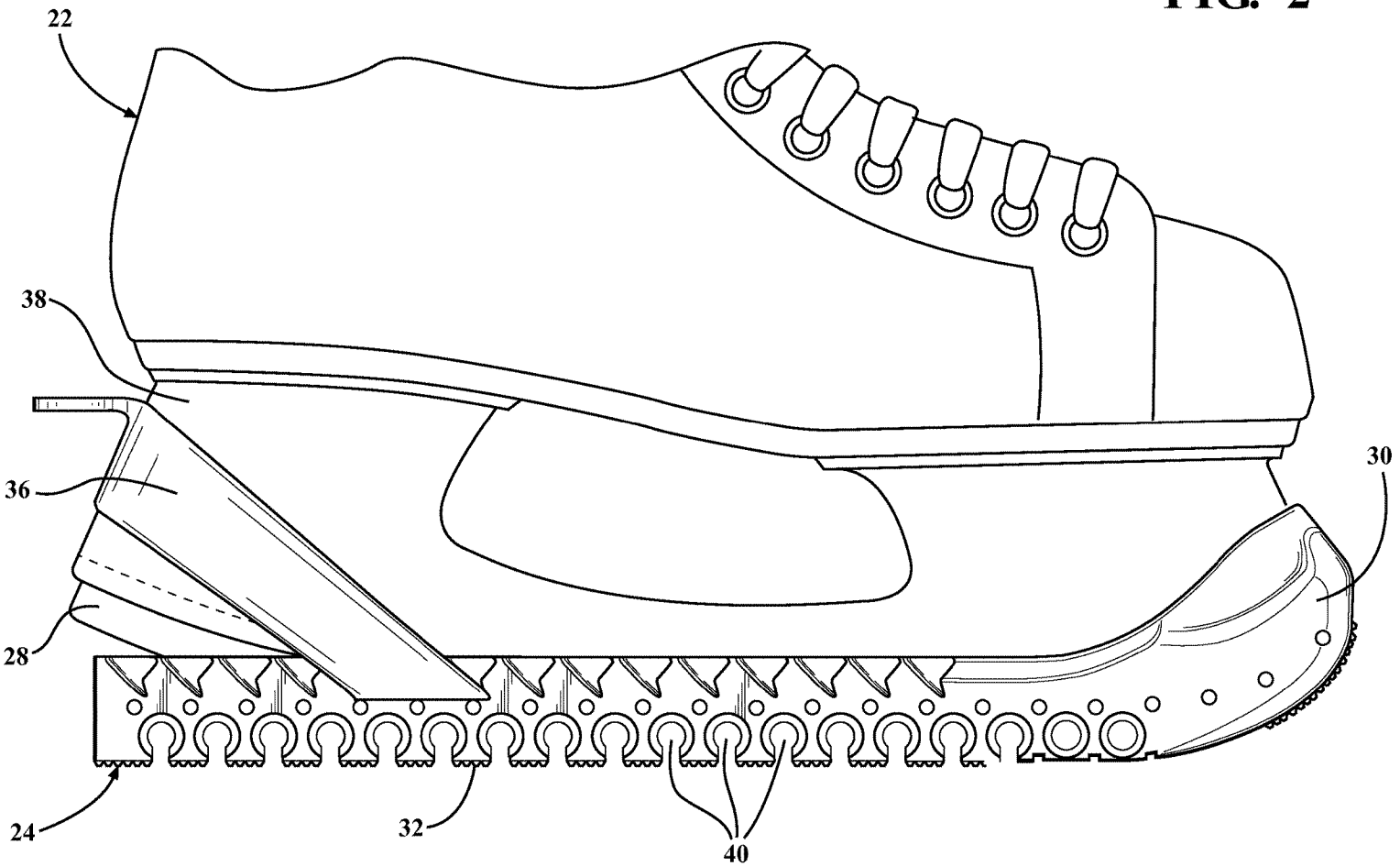
FIG. 2 is a side view showing a skate guard secured with a single runner blade ice skate.

As shown in FIGS. 2 and 3, the skate guard 24 extends longitudinally from a curved front or toe region to a back or heel region and has a top, a pair of lateral sides 30 and a bottom surface 32. The top surface presents a channel 34 which extends along the length of the skate guard 24 for receiving the single runner blade 28 of the traditional ice skate 22. The skate guard 24 further includes an elastic retention strap 36 which is secured to the oppositely facing lateral sides 30 at the heel region for elastically engaging around a back end of a support frame 38 of the ice skate 22 to secure the skate guard 24 with the ice skate 22. The skate guard 24 further includes a plurality of openings 40 which extend between the opposite lateral sides 30 and are longitudinally spaced from one another along the length of the skate guard 24. In the exemplary embodiment, each of the openings 40 is counterbored, or recessed, at each of the lateral sides 30. As shown, in the exemplary embodiment, a plurality of the openings 40 are open at the bottom of the skate guard 24.

Referring back to FIGS. 3-6, the multi-runner blades 26 are separate pieces from one another and may be fabricated of any suitable material including, for example, stainless steel, steel, steel alloys, aluminum, aluminum alloys, plastics or ceramics. The multi-runner blades 26 may be cut or stamped from a flat stock of material. Each multi-runner blade 26 has a generally flat bottom ice-engaging edge 42, which may be ground flat or may be hollow ground depending on what type of edge 42 is desired. The multi-runner blades 26 preferably have a thickness in the range of ⅛" to 3⁄16".

Each of the multi-runner blades 26 has a plurality of apertures 44 which are spaced longitudinally from one another by a predetermined distance which corresponds with the distance between two of the openings 40 in the skate guard 24 for aligning with corresponding ones of the openings 40 in the skate guard 24.

Figure 6:
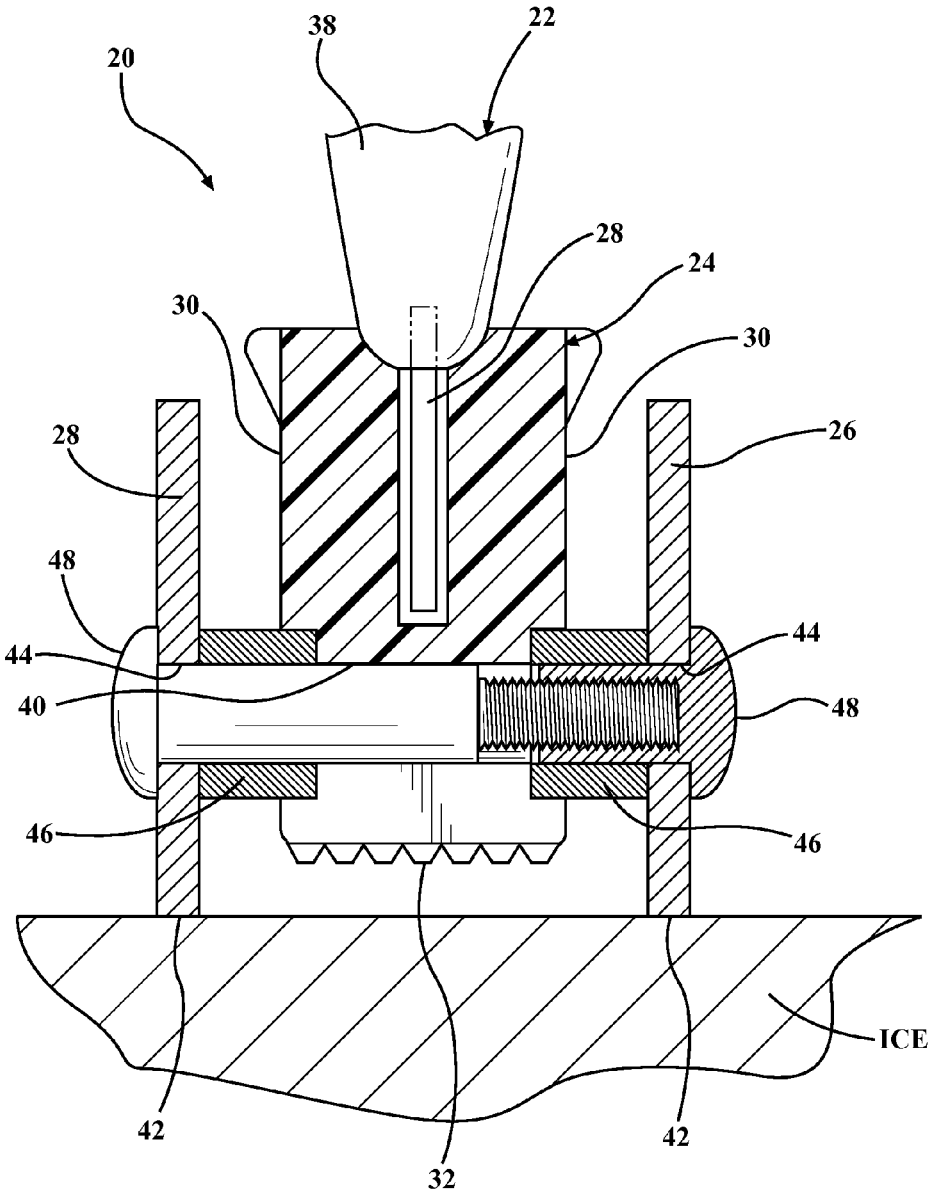
FIG. 6 is a cross-sectional view showing a single runner blade from the ice skate of FIG. 1 installed in the ice skate attachment assembly of FIG. 3.

The mounting hardware of the exemplary ice skate attachment assembly 20 includes a set of bushings 46, or spacers, which are sized to be received in the counterbores of the openings 40 in the skate guard 24, and a plurality of fasteners 48. When inserted into the counterbores of the openings 40, the bushings 46 project or stand out from the lateral sides 30 of the skate guard 24 and provide a flat, firm surface for mounting the multi-runner blades 26. In the exemplary embodiment, the bushings 46 are generally cylindrical in shape. As shown in FIGS. 3 and 6, the fasteners 48 extend through aligned ones of the apertures 44 on the multi-runner blades 26 and the openings 40 on the skate guard 24 and also through the bushings 46 to removably secure the multi-runner blades 26 with the skate guard 24. In the exemplary embodiment, the fasteners 48 include sets of screw and threaded cap (or nut) combinations wherein tools, such as Allen wrenches can be inserted into the heads of the screw and cap to tighten the multi-runner blades 26 into position on either lateral side 30 of the skate guard 24. One or more center bushings may additionally be provided between the skate guard 24 and the multi-runner blades 26 to allow for increased support of the multi-runner blades 26.

Referring now to FIG. 6, once mounted, the multi-runner blades 26 extend vertically below the bottom surface 32 of the skate guard 24 in spaced and parallel relationship with one another. Also, the multi-runner blades 26 are spaced from the lateral sides 30 of the skate guard 24 due to the presence of the bushings 46. The distance between the bottom surface 32 of the skate guard 24 and the ice-engaging edges 42 of the runner blades 26, 28 may be, for example, approximately ⅜". The fasteners 48 shown are held in the opening 40 of the skate guard 24 despite the open bottom of the opening 40 because the opening extends through greater than 180° of curvature and therefore supports both the tops and the bottoms of the fasteners 48 and of the bushings 46.

Another aspect of the present invention is a method or process of mounting at least two multi-runner blades 26 onto a skate guard 24. To install the multi-runner blades 26 onto the skate guard 24, one simply arranges the bushings 46 into the counterbores of the openings 40 on the lateral sides 30 of the skate guard 24 and positions the multi-runner blades 26 such that the apertures 44 on the multi-runner blades 26 are aligned with the openings 40 on the skate guard 24 and the bushings 46. The fasteners 48 are then inserted through the aligned apertures 44, bushings 46 and openings 40 to secure the multi-runner blades 26 with the skate guard 24.

Another aspect of the present invention is a method or process of installing the ice skate attachment assembly 20 or the modified skate guard 24 onto a single runner blade ice skate 22, thereby converting the single runner blade ice skate 22 into a multi-runner blade 26 ice skate 22. To install the ice skate attachment assembly 20 onto the ice skate 22, a user first guides the single runner blade 28 of the ice skate 22 into the channel 34 on the top of the skate guard 24 such that the toe of the support frame 38 (or the blade of a figure skate) is cupped at the front. Next, the user extends the retention strap 36 of the skate guard 24 about the back part of the support frame 38 to resiliently secure the skate guard 24 with the ice skate 22.

Once the user is proficient at skating and no longer needs the assistance of the multi-runner blades 26, the skate guard 24 can be readily converted back to a skate guard 24 by simply removing the multi-runner blades 26 in the reverse manner of installation as described above.

Obviously, many modifications and variations of the present invention are possible in light of the above teachings and may be practiced otherwise than as specifically described while within the scope of the appended claims.

What is claimed is:

1. An ice skate attachment assembly for converting an ice skate having a single ice skate runner blade into a multiple-runner blade ice skate, said ice skate attachment assembly comprising:

a skate guard having a bottom surface, two opposite lateral side faces and including a channel that is open at a top of said skate guard for removable receiving and supporting, the single ice skate runner blade;

at least two skate guard runner blades constructed as separate and discrete parts from one another and each secured with said skate guard and being spaced laterally from one another in facing relation to said lateral side faces of said skate guard, each of said skate guard runner blades extending below said bottom surface of said skate guard to an ice engaging edge;

further including a plurality of bushings disposed between said skate guard and said skate guard runner blades to space said skate guard runner blades from said lateral sides of said skate guard: and wherein said skate guard includes at least two openings that are spaced longitudinally from one another and wherein each of said skate guard runner blades includes a pair of apertures that are aligned with said openings of said skate guard and further including a plurality of fasteners which extend through aligned ones of said openings of said skate guard and said apertures of said skate guard runner blades to detachably connect said skate guard runner blades with said skate guard and wherein said openings on said skate guard are counterbored and said bushings are received in said counterbores.

2. The ice skate attachment assembly as set forth in claim 1 wherein said at least two skate guard runner blades each have a length and said skate guard has a length, and wherein said skate guard runner blades extend at least a majority of the length of said skate guard.

3. An ice skate attachment kit for converting a an ice skate having a single ice skate runner blade into a multiple-runner blade ice skate, said ice skate attachment kit comprising:

at least two skate guard runner blades, each of said skate guard runner blades constructed as separate and discrete parts from one another and each having an ice-engaging edge and being planar with at least two apertures extending laterally through each skate guard runner blade in spaced apart relation to one another;

mounting hardware receivable in said apertures for detachably connecting the skate guard runner blades with a skate guard on opposite lateral sides of the skate guard:

a skate guard having a channel open at a top of said skate guard;

wherein said skate guard includes at least two openings that are spaced from one another in a longitudinal direction and wherein said apertures of said skate guard runner blades alien with said openings in said skate guard;

wherein said mounting hardware includes at least two fasteners configured to extend through aligned ones of said openings in said skate guard and said apertures in said skate guard runner blades to detachably connect said skate guard runner blades with said skate guard;

further including a plurality of bushings for spacing said skate guard runner blades form said lateral sides of said skate guard; and wherein the openings in the skate guard are counterhored and the bushings are sized to be received it the counterbores.

* * * * *